US006193184B1

(12) United States Patent
Hansen

(10) Patent No.: US 6,193,184 B1
(45) Date of Patent: Feb. 27, 2001

(54) METHOD AND A SYSTEM FOR CONTROLLING TENSION OF PAPER AND FOIL WEBS

(75) Inventor: Per Henrik Hansen, Malling (DK)

(73) Assignee: Tetra Pak Hoyer A/S, Højbjerg (DK)

( * ) Notice: Subject to any disclaimer, the term of this patent is extended or adjusted under 35 U.S.C. 154(b) by 0 days.

(21) Appl. No.: 09/297,059

(22) PCT Filed: Nov. 3, 1997

(86) PCT No.: PCT/DK97/00499

§ 371 Date: Apr. 29, 1999

§ 102(e) Date: Apr. 29, 1999

(87) PCT Pub. No.: WO98/19948

PCT Pub. Date: May 14, 1998

(30) Foreign Application Priority Data

Nov. 1, 1996 (DK) ..... 1220/96

(51) Int. Cl.[7] ..... B65H 23/18
(52) U.S. Cl. ..... 242/418; 226/34
(58) Field of Search ..... 242/418, 418.1; 226/34, 35, 174

(56) References Cited

U.S. PATENT DOCUMENTS

| | | | | |
|---|---|---|---|---|
| 2,814,486 | * | 11/1957 | Gurley et al. | 226/34 |
| 3,700,153 | * | 10/1972 | Delair et al. | 226/174 |
| 3,878,979 | * | 4/1975 | Cristiani | 226/34 |
| 4,124,156 | * | 11/1978 | Waffner | 226/34 |
| 4,220,274 | * | 9/1980 | Schubert et al. | 226/34 |
| 5,957,359 | * | 9/1999 | Paivinen | 242/418 |

FOREIGN PATENT DOCUMENTS

| | | | |
|---|---|---|---|
| 0 695 714 | * | 2/1996 | (EP) . |
| 0 738 796 | * | 10/1996 | (EP) . |
| 2 074 618 | * | 11/1981 | (GB) . |
| 2 078 208 | * | 1/1982 | (GB) . |

OTHER PUBLICATIONS

Patent Abstracts of Japan, vol. 15, No. 117, M–1095, Abstract of JP 3–8653 A (Konica Corp), Jan. 16, 1991 (16.01.91).*

* cited by examiner

*Primary Examiner*—John M. Jillions
(74) *Attorney, Agent, or Firm*—Nixon Peabody LLP; David S. Safran

(57) ABSTRACT

In connection with the unreeling of a paper or foil web from a supply reel, e.g. in a flowpacking machine, it is well known to move the web through an adjustment station for maintaining a constant tension of the web in the outer length thereof. Normally, this is achieved by the use of a synchronously driven unreeling roller partially entwined by the web and a system for adjusting the degree of entwining based on a current detection of the web tension. With the invention this is simplified by driving the unreeling roller with a peripheral speed noticeably higher than the web speed, whereby it is possible with a suitable angle of entwining to achieve both a relatively low web tension and an automatically self-adjusting, constant web tension. By virtue of the associated, rather low dynamic friction between the roller and the web, it is even possible to effectively control or maintain the lateral positioning of the web merely by the use of simple abutments for co-operation with the side edges of the web.

12 Claims, 1 Drawing Sheet

METHOD AND A SYSTEM FOR CONTROLLING TENSION OF PAPER AND FOIL WEBS

The present invention relates to a method and a system for controlling a material web, preferably of paper or plastic and in particular in connection with the packaging of products such as edible ice products, whereby at least one web is guided in an S-configuration over a set of guiding rollers in order to achieve a stabilized web tension.

In connection with a continuous advancing of a paper web—from unreeling to working or handling—in, for example, packaging machines for flow packing it is known to regulate the tension of the web in order to ensure a well defined longitudinal folding of the web, yet also to avoid that the guiding edges used for such a folding exhibit a cutting effect or even cause a rupture of the web, while a stabilized tension of the web also contributes to ensuring a desired uniformity of the final products.

For the folding it is important that the paper web is drawn over the folding edges with a sufficient tension to ensure that a longitudinal folding will take place, but without the tension being so high that the web is ruptured as a consequence of the folding edges being turned into cutting edges. Likewise it is important that the web be held correctly positioned in the lateral direction relative to the folding edges in order to ensure the desired folding profile relative to imprint details on the wrapping web.

The paper web is advanced in being pulled through the packaging line from the outer end of the web, by suitable advancing means such as draw rollers.

The tension in the web occurs by virtue of the web being pulled outwardly from a tension adjustment system, in which it is exposed to a controllable friction, based on a current detection of the web tension. In the adjustment system the web is guided about a synchronously rotating friction roller with an adjustable deflection angle, the web as paid out from this roller being guided about a delivery roller in the form of a dancing roller, the position of which is controllable for adjustment of the said deflection angle of the web. When the friction roller is driven with a peripheral speed corresponding to the moving speed of the web, a well defined frictional engagement is established between the web and the roller surface, given by the particular friction coefficient, the deflection angle and the pressure of the web against the roller surface. If for some reason a rising or falling web tension occurs, such a change may be return adjusted by causing the dancing roller to change its position for changing the said deflection angle of the web for a corresponding decreasing or increasing of the web friction against the roller, until the tension is detected to be normal.

In principle, all this functions well in practice, but the requirement of both a web tension detector and a moving system for the said dancing roller is a complication, and another problem is that in general the web tension has to be relatively high, higher than optimally desirable.

There is an associated, different problem, viz. with respect to the correct positioning of the web in the transverse direction. It is well known that in connection with the advancing of web materials via guiding rollers it is almost impossible to effect a lateral adjustment by mechanical abutment means in case of small changes of the web direction at the intake end, so it is required, moreover, to use detection means for detecting lateral displacements of the web and, controlled thereby, means for compensation adjustment of a roller for achieving an accurate lateral positioning of the paid out web, this being a significant additional and expensive complication. The problem is due to the fact that in case of a noticeable friction between a web material and a support surface therefor it is not possible to subject the web to an effective lateral displacement just by applying pressure to a side edge of the web, viz. when the web itself is not sufficiently stiff to be able to transfer the required pressure to the whole width of the web for overcoming the said friction-with the support surface.

In plural lane packaging systems, more webs are moved in parallel through the packing machine, such that packing can be effected in a plurality of lanes for increasing the overall capacity of the system. These webs, which are advanced with the same speed, are handled by common friction and pay-out rollers and are also moved through a common tension adjustment station. Thus, the handling of the webs in plural lane systems is not particularly complicated due to the additional webs. However, problems may arise in case of production disturbances imparting changes in the tension of the single webs, and besides, the plural lane system is limited to the handling of the same products in all the packaging lanes.

On this background, it is the purpose of the invention to provide a method and an associated system for adjusting the tension of a paper or sheet web to a relatively low tension level. Moreover, it is desired to provide a method and a system that will be well suited for individual control of the webs in plural lane packing machines.

Basically, the invention is characterized in that the friction roller in the web tension adjustment station is driven with a peripheral speed which is substantially higher than the advancing speed of the web, such that a sliding friction is established between the web and the friction roller.

With the invention, an entirely novel principle for the adjustment of the tension in a paper or sheet web has been provided.

Inasfar as the friction roller is driven with a noticeably higher speed, the web will be subjected to an "auxiliary drive" due to the friction, but now it is no longer the static friction, but a considerably lower dynamical friction by the provoked marked sliding between the elements. Accordingly, a drop in tension in the paid out web will occur across the friction roller, compared to the tension at the intake side, resulting in a decreased tension in the web as advanced through the folding tools, whereby the risk of damaging the web by these tools will be lowered considerably.

Moreover, the sliding engagement will condition a self adjusting effect with respect to the web tension, such that the adjustment system will not have to include special sensor or controlling units. Should the web tension decrease, the web will be pulled against the friction roller with a lower force, whereby the sliding friction and therewith the auxiliary drive effect of the friction roller will decrease. For a lower auxiliary drive effect of the friction roller, the said tension reducing effect on the web will also be decreased, whereby the original tension in the web will be reestablished automatically. Correspondingly, the auxiliary drive will be strengthened if the web tension tends to rise, this primarily referring to the tension in the web stretch between the web supply reel and the adjustment system, as the web is unreeled. Thus, the pulling off of the web will be effected with an increasing force, but in such a manner that the increased tension will not be transferred to the web length delivered from the adjustment system.

Thus, with a system according to the invention it is not a requirement to be able to change the deflection angle about the friction roller in order to adjust the web tension. The pay-out roller arranged in connection with the friction roller, need not be dynamically movably arranged, although it will of course still be an option that it could be arranged as a dancing roller in order to still enable a change of the deflection angle. However, it should be position adjustable, viz. to a correct position relative to the actual friction coefficient.

The disclosed principle of the invention is also well suited for use in a plural lane packaging machine, where more webs are advanced in parallel, inasfar as the tension of the single webs as handled by common friction and pay-out rollers is individually self adjusting, implying allowable variations of the material structure and thickness etc. of the paper webs, without this affecting the quality of the finished products or giving rise to production disturbances. The sliding friction in the adjustment system moreover provides for the advantage that the webs can pass the same friction roller, even if the advancing speeds of the webs are not identical. This results in a far greater production flexibility of the plural lane packing machines.

Also, it will be possible to pack different sizes and/or types of products on the different lines.

If a further adjustment possibility is desired, a common guiding roller in a plural lane system can be arranged as a dancing roller in a movable suspension. It will also be possible to use individual pay-out rollers for each of the lines, such that the deflection angles can be adjusted individually.

In connection with the invention there is another aspect of such a significance that in some connections it may even overshadow the tension adjustment, viz. relating to the said required guiding or maintaining of the lateral location of the material web.

As mentioned, the invention provides for changed friction conditions in connection with the disclosed auxiliary drive for the web, but a reduced driving or holding friction will apply in general for the frictional engagement, i.e. also in the transverse direction. Therewith, it is correspondingly much easier to effect a provoked lateral displacement or side anchoring of the web. Already for a moderate lateral stiffness of the web the force required for this purpose can be established solely with the use of simple side edge abutments, this denoting a great simplification.

It should be mentioned that in connection with the guiding of yarn, see GB 2,078,792, it is known to make use of a yarn reversing roller driven with a peripheral speed which is bigger or smaller than the speed of the yarn, the yarn being guided laterally to and fro along the roller in order to be reeled onto an elongated yarn bobbin. The problems here in focus relate to the tension conditions in the triangular pattern operatively described by the yarn, when the latter is paid out from a fixedly mounted flange wheel and, spaced therefrom, is guided to and fro along the said reversing roller. Problems in that respect are irrelevant for the present invention, and there is not disclosed anything about the advancing of web structures, nor about conditions for choosing between the said higher and lower peripheral speed or about any qualified choice with respect to the degree of surrounding about the reversing roller.

In the following the invention is described in more detail with reference to the drawing, in which.

Figure 1:
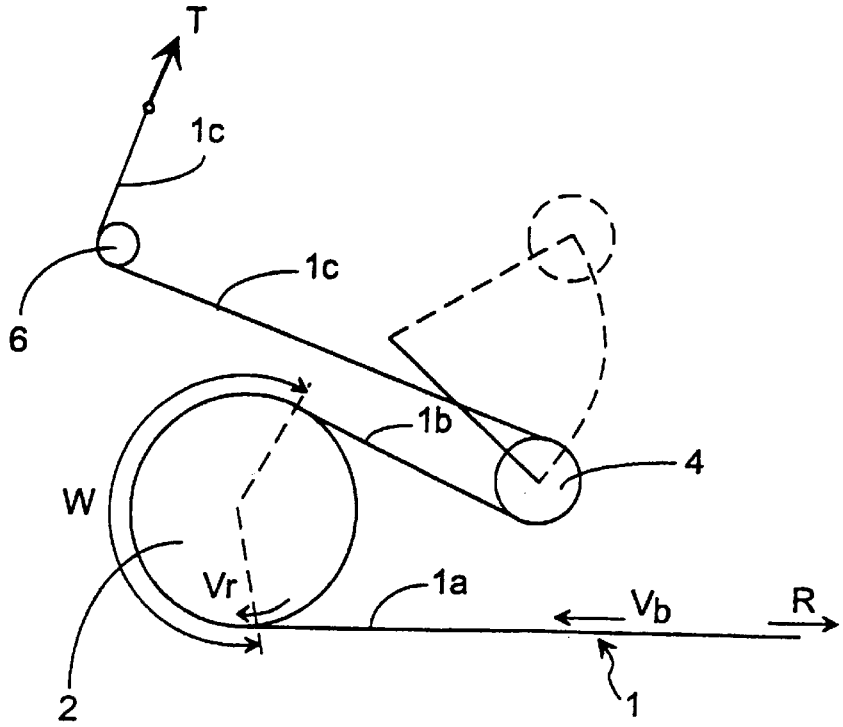
FIG. 1 is a schematic view of an adjustment system according to the invention, for controlling a paper web.

In FIG. 1, an adjustment system according to the invention is shown, in which a paper web 1 is guided through an inlet area 1*a*, about a friction roller 2 with a deflection angle w, further through an outlet area 1*b* and over a web reversing roller 4. The further pay-out 1*c* takes place over a guiding roller 6 to non-illustrated working units such as folding tools. The paper web 1 is pulled through the tension adjustment system and the other handling and working units by means of a main pulling action represented by the arrow T. The associated main drive is arranged at the outer end of the web stretch 1*c* and is adapted to advance the web 1 with a speed vb. The friction roller 2 is connected with driving means driving this roller with a peripheral speed vr, which is substantially higher than the web speed vb.

The paper web is drawn off from a supply which offers a certain resistance R against the drawing off, this resistance normally being non-constant. If the resistance increases, the pull T will cause the web 1 to be pressed harder against the friction roller 2, whereby the latter will increase its function as an auxiliary drive such that the tension in the web stretch 1*a* will increase, but be held constant in the stretches 1*b* and 1*c*. The attainment of this constancy will be a matter of selecting a suitable deflection angle w, and as indicated in dotted lines the web reversing roller 4 can be movably mounted such that it can be positioned for defining a desired deflection angle all according to the friction coefficient between the web and the friction roller 2. This can be considered analogously with the movement of the said dancing roller in conventional adjustment systems, but with the marked difference that with the invention the adjustment is static and not necessarily dynamic for achieving a constant tension in the web length ic.

If for other reasons a tension change occurs in the web length 1*c*, the effect will be quite the same, viz. that against the resistance R a tension change will occur, which, when increased, will intensify the auxiliary drive of the friction roller 2, while when decreased it will weaken the auxiliary drive, such that in both cases the change of tension will be counteracted.

The sliding, dynamical advancing friction between the web 1 and the friction roller 2 will imply that the friction also in the transverse direction is significantly lower than the static friction. This means that the forces required to overcome the friction and correct the transverse location of the web on the friction roller 2 are so relatively weak that in practice it is possible to apply such transverse forces directly to the edges of the web, without any hazard of damaging the web.

Figure 2:
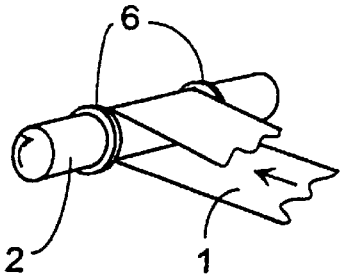
FIGS. 2 and 3 show different embodiments of means for positioning of a paper web on a roller.

In order to utilize this for an effective transverse stabilization of the web, the friction roller may be provided with annular radial projections 6, as shown in FIG. 2. These annular ribs can be made integral with the roller or as ring members to be tightened to the roller. The latter embodiment has the advantage that the ribs may be manually moved according to the width of the web to be handled.

Figure 3:
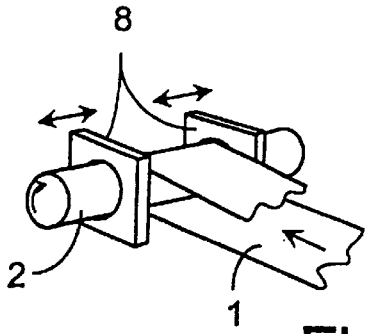

An alternative embodiment of these positioning means is shown in FIG. 3. Here, the two lateral guiding members 8 are placed in connection with the friction roller 2, but without rotating therewith. Thus, they are freely adjustable in the axial direction of the roller 2 for lateral positioning of the paper web 1.

Figure 4:
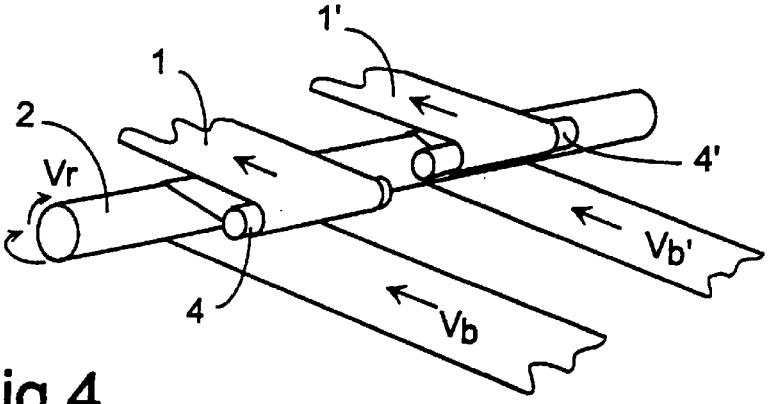
FIG. 4 illustrates an embodiment of the invention in connection with a plural lane system.

FIG. 4 shows a system for controlling a number of paper webs 1,1' laid about the same friction roller 2. Because the latter is rotated with a peripheral speed vr, which is noticeably higher than any one of the web velocities vb,vb' of the paper webs 1,1', there will always be a sliding friction between the friction roller 2 and these webs. Thus, the sliding friction is established even when the velocities vb and vb' are not equal.

As further apparent from FIG. 4, in a preferred embodiment of the invention it is chosen to use individual, adjustable web reversing rollers 4, 4' in order to take advantage of the associated additional adjustment possibility.

The invention is not limited to use in connection with tension adjustment of paper webs in packaging machines. Thus, the method and the associated system according to the invention may well be used for tension and positioning control of different types of material webs such as plastic sheet, conveyor belts and the like, where the invention may offer the same advantages.

In principle, the web reversing roller 4 could just as well be used for co-operation with the inlet stretch 1*a*.

What is claimed is:

1. A method of providing constant tension in a paid-out stretch of web material in a flow-packing machine, whereby said web material is supplied with a variable tension from a supply source to a web tension adjusting station from which said web material is pulled out, said web material partly surrounding a rotatably driven friction roller operating as an auxiliary driving means on said web material and having an angle of deflection determined by the location of an adjustable control roller, said method comprising the steps of:

rotating said friction roller with a peripheral speed directed in the pay-out direction, said peripheral speed being substantially higher than the advancing speed of said web material; and selecting an angular position of said control roller in accordance with the friction coefficient between said web material and said friction roller for producing an increase in web tension by an associated increase of web pressure against said friction roller, said increase in web tension automatically resulting in an increased dynamic friction between said friction roller and said web material to increase the auxiliary driving effect upon said web material so as to maintain substantially constant web tension and increase the force with which said web material is pulled from said supply source.

2. A method according to claim 1, further comprising the step of stabilizing the transverse position of said web material on said friction roller by engaging the side edges of said web material with guide means.

3. A method according to claim 1, wherein said web material is composed of a paper material.

4. A method according to claim 1, wherein said material web is composed of foil material.

5. A flow-packing apparatus having means for advancing a single line of web material from a web supply reel at an advancing speed to a delivery station and producing a web tension during the advancing thereof, said apparatus comprising;

a web tension adjusting station positioned intermediate of said supply reel and said delivery station including a rotatably driven friction roller in frictional engagement with said web material for automatically controlling and maintaining substantially constant web tension, and an adjustable web diversion roller for determining the angle of deflection of said web material about said friction roller; and wherein said friction roller is driven at a peripheral speed substantially higher than the advancing speed of said web material.

6. An apparatus according to claim 5, wherein said friction roller includes abutment means for lateral positioning said web material and having contact surfaces positioned proximate the area of engagement between said web material and said friction roller for guiding engagement with the side edges of said web material.

7. An apparatus according to claim 6, wherein said abutment means are laterally displaceable in the axial direction of said friction roller.

8. An apparatus according to claim 6, wherein said abutment means include annular radial projections axially positioned on said friction roller.

9. An apparatus according to claim 8, wherein said annular radial projections are laterally displaceable.

10. An apparatus according to claim 5, wherein the position of said diversion roller is fixed.

11. An apparatus according to claim 5 comprising at least two advancing lines of web material, wherein said advancing lines are in dynamic frictional engagement with said friction roller, irrespective of possible different speeds of said at least two advancing lines of web material.

12. An apparatus according to claim 5 comprising at least two advancing lines of web material, wherein said advancing lines are in dynamic frictional engagement with said friction roller, irrespective of individual deflection angles of said at least two advancing lines of web material about said friction roller.

* * * * *